United States Patent [19]

Kalinowski

[11] Patent Number: 4,913,708

[45] Date of Patent: Apr. 3, 1990

[54] GRINDING WHEEL

[75] Inventor: Paul W. Kalinowski, Boylston, Mass.

[73] Assignee: Norton Company, Worcester, Mass.

[21] Appl. No.: 272,976

[22] Filed: Nov. 18, 1988

[51] Int. Cl.[4] ..... B24D 11/00

[52] U.S. Cl. ..... 51/295; 51/293; 51/298; 51/309

[58] Field of Search ..... 51/295, 293, 298, 309

[56] References Cited

U.S. PATENT DOCUMENTS

| | | | |
|---|---|---|---|
| 1,482,792 | 2/1924 | Hartman | 51/307 |
| 1,482,793 | 2/1924 | Hartman | 501/127 |
| 1,910,444 | 5/1933 | Nicholson | 51/308 |
| 2,294,239 | 8/1942 | Novotry et al. | 51/295 |
| 2,303,284 | 11/1942 | Klein | 51/308 |
| 2,497,469 | 2/1950 | Robie | 51/301 |
| 2,527,044 | 10/1950 | Walton et al. | 51/308 |
| 3,269,815 | 8/1966 | Koopman | 51/308 |
| 4,021,208 | 5/1977 | Oberbichler | 51/295 |
| 4,246,004 | 1/1981 | Busch et al. | 51/295 |
| 4,278,449 | 7/1981 | Helletsberger et al. | 51/309 |
| 4,472,173 | 9/1984 | Bruning | 51/298 |
| 4,561,863 | 12/1985 | Hashimoto et al. | 51/295 |

OTHER PUBLICATIONS

Industrial and Engineering Chemistry, vol. 47, No 12 (Dec. 1955) pp. 2493–2494, Loring Coes.

*Primary Examiner*—Paul Lieberman
*Assistant Examiner*—Willie J. Thompson
*Attorney, Agent, or Firm*—Arthur A. Loiselle, Jr.

[57] ABSTRACT

The grinding performance of organic bonded abrasive bodies whose abrasive portion is wholly or partially composed of aluminous abrasive grits is significantly improved by providing a magnesium oxide-rich or manganese oxide-rich coating on furfural-wetted grits just prior to addition of resin and filler in the mixing process.

15 Claims, 2 Drawing Sheets

GRINDING WHEEL

BACKGROUND OF THE INVENTION

In the design and manufacture of grinding wheels it is common practice to embed abrasive particles in a binder. During the grinding process, the wear or erosion of the wheel takes place as the abrasive particles or grains either fracture or are pulled from the binder. In order to lock the grains securely in the binder, it has been suggested that the grains be coated with a special coupling agent before placement in the binder to increase the adherence between the grains and the binder. In addition, it is well-known to use an active filler in the binder which serves to improve grinding performance. These active fillers are incorporated in the bond of resin-bonded abrasive bodies as grinding aids to provide a chemical attack on the metal being ground, to prevent re-welding of metal chips, to promote intergranular corrosion preceding actual chip formation, or to act as an extreme pressure lubricant. While the common practice is to incorporate these active fillers homogeneously throughout the binder or bond, it has also been suggested that the active substance be coated on the grain surface. Because they are most often present in large amounts in the bond, they may present a danger to the operator and add substantial cost to the abrasive wheel. These and other shortcomings of the prior art devices and methods have been obviated in a novel manner by the present invention.

It is, therefore, an outstanding object of the invention to provide a grinding wheel having improved metal removal rate.

Another object of this invention is the provision of a grinding wheel having improved grinding efficiency.

A further object of the present invention is the provision of a grinding wheel which is simple in construction, which is inexpensive to manufacture, and which is capable of a long life of useful service.

It is another object of the instant invention to provide a method of producing a grinding wheel having improved performance.

A still further object of the invention is the provision of process for manufacturing an abrasive element having an improved metal removal rate and grinding efficiency.

SUMMARY OF THE INVENTION

In general, the invention has to do with a grinding wheel having an organic bonded abrasive body whose abrasive portion is whooly or in part composed of silicon carbide, aluminous abrasives, such as fused aluminum oxide, sintered alumina, sintered sol gel alumina, alumina-zirconia, or sintered bauxite, and whose abrasive surfaces are coated with metallic oxides, such as magnesia or manganese dioxide, during the mixing process.

Alternatively, the invention consists of a method of forming an abrasive wheel, comprising the steps of preparing a mass of abrasive grains, coating the grains with a powder of a coating material selected from the class consisting of magnesia and manganese dioxide, preparing a mixture of the coated grains with a binder, forming the mixture under pressure into a wheel-like form, heating the form at a first temperature to partially set the binder, and heating the form at a second temperature to finish set the binder. The coating of the grains is accomplished by first wetting the surfaces of the grains and then adding the coating material to the wetted grains.

BRIEF DESCRIPTION OF THE DRAWINGS

The charactr of the invention, however, may be best understood by reference to one of its structural forms, as illustrated by the accompanying drawings, in which:

FIG. 3 is a flow-chart of steps taken in the process of manufacturing the grinding wheel.

DESCRIPTION OF THE PREFERRED EMBODIMENT

Figure 1:
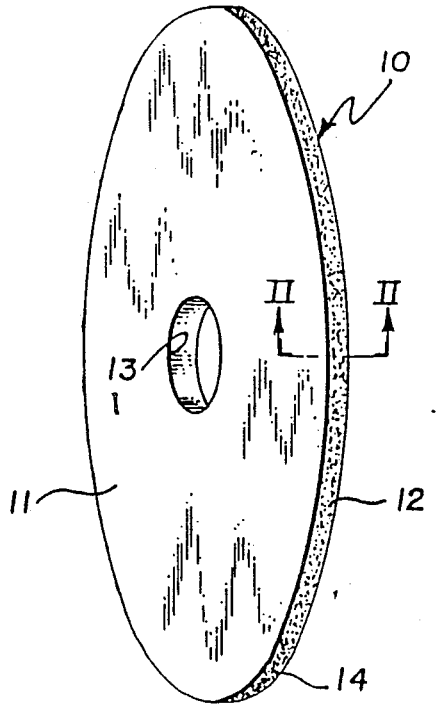
FIG. 1 is a perspective view of a grinding wheel incorporating the principles of the present invention.

Referring first to FIG. 1, wherein are best shown the general features of the invention, the grinding wheel, indicated generally by the reference numeral 10, is shown as having a disk-like body 11 having a central bore 13 to provide for mounting on the spindle (not shown) of a grinding machine.

Figure 2A:
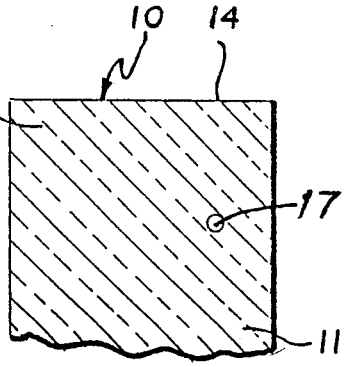
FIG. 2 is a sectional view, somewhat enlarged, of the grinding wheel, taken on the line II—II of FIG. 1.
Figure 2B:
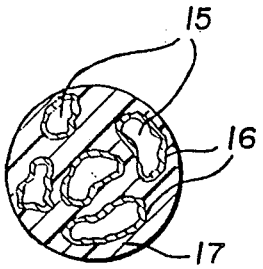

FIG. 2 shows the manner in which the wheel is formed with abrasive particles or grains 15 provided with a coating 16 and locked together by a bond 17. In the preferred embodiment the abrasive particles 15 consists of abrasive, grains, such as silicon carbide, fused aluminum oxide, sintered alumina, sintered bauxite, sintered sol gel alumina, and cofused alumina-zirconia. Similarly, the preferred material for the coating 16 is powdered magnesia or powdered manganese dioxide in an amount in the range from 0.2% to 3.0% by volume of the entire abrasive body. The bond 17 is a resin, such as phenol-formaldehyde, phenol-furfural, analine-formaldehyde, urea-formaldehyde, phenoxy, epoxy, polyester, polyurethane, polyimide, and polybenzimidazole.

FIG. 3 illustrates the steps used in carrying out the process for manufacturing the wheel if the wheel is of the hot pressed type. The first step 31 consists of preparing a mass of abrasive grains 15. The second step 32 involves wetting the grains with, for example, furfural, a so-called plasticizer or pick-up agent. The third step 33 consists of covering the grains with powdered magnesia or powdered manganese dioxide to form the coat 16. The fourth step concerns the mixing of the coated grains with the bond, which consists, preferably, of a thermosetting resin with or without fillers. The fifth step 35 consists of forming the mixture into the desired shape under pressure, while simultaneously performing the sixth step 36 of heating the form at a first temperature. The seventh (and last) step 37 involves curing the bond at a second temperature to complete the grinding wheel 10.

SPECIFIC EMBODIMENT OF THE INVENTION

The organic bonded abrasive bodies of the invention are preferably, but not limited to, hot-pressed snagging wheels, with near zero porosity, commonly used to condition stainless or tool steel billets, slabs and castings.

The preferred abrasive portion of the invention body is selected from fused aluminum oxide, sintered alumina, sintered bauxite, sintered sol gel (including seeded sol gel) alumina and mixtures thereof with cofused alumina-zirconia, sintered alumina-zirconia, and silicon carbide. These may be employed in a wide variety of grit sizes well known in the art for a chosen application.

For snagging wheels, a grit size range from a coarse 4 grit to a medium 36 grit is usually employed.

A conventional organic resinoid binder may be mixed with a variety of fillers to bind the abrasive body together. Preferably, the organic binder is a thermosetting mixture of powdered novolac with 10% of hexamethylenetetramine cross-linking agent added. This resin is available from Reichold Chemical Company as Varcum 29318 long-flow phenolic resin. However, other thermosetting phenolic resins with modifiers or different levels of hexamethylenetetramine may be used.

Other resins which may be employed include polyester, polyimide, polybenzimidazole, polyurethane, phenoxy, phenol-furfural, analine-formaldehyde, urea-formaldehyde, epoxy, cresol-aldehyde, resorcinol-aldehyde, urea-aldehyde, melamine-formaldehyde, and mixtures thereof.

As is well known there are various inorganic and organic fillers and mixtures of fillers which may be put in organic bonded abrasive bodies for improving strength, reducing cost, and, most importantly, for improving grinding performance. The fillers are usually considered to be part of the bond and are in a finely divided state, much smaller than the primary grinding abrasive grits.

Suitable conventional and well known active fillers are cryolite, fluorspar, iron sulfide, zinc sulfide, magnesia, silicon carbide, sodium chloride, potassium fluoborate, calcium oxide, potassium sulfate, copolymer of vinylidene chloride and vinyl chloride (Saran B), polyvinylidene chloride, polyvinyl chloride, other fibers, sulfides, chlorides, sulfates, fluorides and mixtures thereof. Typical reinforcing fillers are fine inorganic materials like silicon carbide and glass fibers chopped or in cloth form.

A practical example of compositions and ingredients for producing wheels according to the invention are shown in Tables I and II.

TABLE I

Wheel Composition % by Volume Excluding Pores and Pick-up and Wetting Agents (Furfural and Cedrene/Cedrol)

| Wheel | A | B | C |
|---|---|---|---|
| 16 grit size 76A sintered bauxite abrasive | 40 | 40 | 40 |
| powdered resin | 22.79 | 22.67 | 22.67 |
| Potassium Sulfate powder | 5.04 | 5.01 | 5.01 |
| Iron Sulfide powder | 19.04 | 18.94 | 18.94 |
| Sodium Chloride powder | 4.09 | 4.07 | 4.07 |
| SARAN B copolymer of vinylidene and vinyl chloride | 1.68 | 1.67 | 1.67 |
| CaO | 3.36 | 3.34 | 3.34 |
| Chopped glass fibers (6 mm) | 4.0 | 4.0 | 4.0 |
| Magnesia, calcined powdered | | 0.3 | |
| Manganese dioxide, powdered | ——— | 0.3 | ——— |
| TOTAL: | 100.0 | 100.0 | 100.0 |

A batch of three hot-pressed test wheels was made using the compositions shown in Table I. These wheels were 16" (40.64 cm) in diameter, 1½" (3.81 cm) in thickness and with 6" (15.24 cm) hole size. A bond blend was first prepared using all the ingredients shown in Table I for wheel A except the 76A abrasive and the chopped fiberglass. The same bond blend was used in preparing wheels B and C. The magnesia and manganese dioxide of wheels B and C, respectively, were added separatively to the furfural wetted abrasive.

In preparing the composition for molding into wheels, the abrasive grain is weighed into a mixing bowl and wetted with 7.9 cc of furfural per pound of abrasive (17.4 cc per kg of abrasive). For the standard wheel A, this step is followed by adding the bond blend of resin plus fillers followed by the addition of chopped fiberglass. and 5 cc of cedrene/cedrol per pound of resin; however, for wheel B and C the magnesia and manganese dioxide, respectively, are added to wetted grain followed by the bond blend of resin plus fillers with chopped glass again added last. This latter procedure provides a magnesia-rich layer on the abrasive surfaces of wheel b and a manganese dioxide-rich layer on the abrasive surfaces of wheel C.

It should be noted that other wetting agents, such as liquid phenolic resin, furfural alcohol, liquid epoxy or mixtures thereof may be used.

The prepared mix of abrasive and bond was placed in a steel mold and hot-pressed at 2.5 tons per square inch (351.5 kg/cm2) and 160 degrees Celsius for one hour. The wheels were then stripped from the mold and post-cured for 24 hours at 200 degrees Celsius.

The cured wheels were then tested by swing-frame snag grinding for fifteen minutes each on 18–8 stainless steel billets using a wheel speed of 9500 sfpm (48.3 smps) and a constant grinding energy of 30 kw and 35 kw, respectively. The comparative grinding results are shown in Tables II and III.

TABLE II

Grinding Test Results on 18-8 Stainless Steel

| Wheel | Abrasive coating | Wheels Wear Rate in³/hr | (dm³/hr) | lb/hr | Metal Removal Rate (kg/hr) | lb/in³ | G Ratio (kg/dm³) | Grinding Efficiency (kg²/cc) | |
|---|---|---|---|---|---|---|---|---|---|
| | | | | At 30 Kw | | | | | |
| A | none | 29/1 | (.477) | 212 | (96.1) | 7.28 | (201) | 386 | (19.4) |
| B | MgO | 25.0 | (.410) | 209 | (94.8) | 8.36 | (231) | 437 | (21.9) |
| C | $MnO_2$ | 26.2 | (.429) | 213 | (96.6) | 8.13 | (225) | 433 | (21.8) |
| | | | | At 35 Kw | | | | | |
| A | none | 40.3 | (.661) | 279 | (126.5) | 6.92 | (191) | 483 | (24.2) |
| B | MgO | 33.7 | (.552) | 277 | (125.6) | 8.22 | (227) | 569 | (28.6) |
| C | $MnO_2$ | 41.5 | (.680) | 292 | (132.4) | 7.04 | (195) | 514 | (25.8) |

Table III which follows gives the relative grinding results in percent compared to those of the standard wheel without grain coating.

TABLE III

| Wheel | Abrasive coating | Wheel Wear Rate | Metal Removal Rate | G Ratio | Grinding Effcncy |
|---|---|---|---|---|---|
| | | Relative Grinding Test Results in Percent | | | |
| | | | At 30 Kw | | |
| A | none | 100 | 100 | 100 | 100 |
| B | MgO | 86 | 99 | 115 | 113 |
| C | $MnO_2$ | 90 | 100 | 112 | 112 |
| | | | At 35 Kw | | |
| A | none | 100 | 100 | 100 | 100 |
| B | MgO | 84 | 99 | 119 | 118 |
| C | $MnO_2$ | 103 | 105 | 102 | 106 |

G-ratio represents the quantity of metal removed per volume of wheel consumed and is a frequently used measure by wheel consumers. Another frequently used measure of wheel quality is the square of the metal removed divided by the volume of wheel consumed. This is often called grinding efficiency and places emphasis on the rate of metal removal.

As can be seen from Table III, the use of MgO-rich coating of the abrasive grain in wheel B improved the G-ratio by 15 and 19% and the grinding efficiency by 13 to 18% over the standard noncoated abrasive wheel A. The use of manganese dioxide as a coating in wheel C improved the G-ratio by 2 to 12% and the grinding efficiency by 6 to 12% over the standard wheel A. These improvements in both G-ratio and grinding efficiency by the invention disclosed hereinabove are a significant and unexpected advancement in the state of the art to which it pertains.

Although it is not specifically disclosed it is obvious that the invention can be used in forms of organic bonded abrasive bodies other than hot-pressed snagging wheels. Examples of such bodies are cutting-off wheels, segmental wheels, cylinders, cup wheels, disc wheels, portable dish and saucer wheels, and foundry floor stand wheels.

It is evident that the present invention involves the discovery that the addition of a relatively small amount of calcined magnesia or manganese dioxide to wetted aluminous abrasive grits followed by normal addition of bond mix (filler plus resin) will produce a bonded abrasive body with significantly improved grinding performance.

The mechanism for the improved grinding performance is not yet fully understood, but one possibility is the formation of an alumina-magnesia or an alumina-manganese oxide eutectic on the abrasive surface from the heat of grinding. This surface condition may result in a toughened abrasive grit and prevent macro-fracturing. Another possibility is the formation of $MgAl_2O_4$ or $MnAl_2O_4$ spinel at the abrasive surface by the heat of grinding. The high friability of spinel results in easy abrasive fracturing as dulling builds up pressure, but since only the surface of the abrasive is involved, fracturing is micro, rather than the macro-fracturing usually associated with spinels. The microfracture replenishes a sharp point on the abrasive grit to more easily penetrate the workpiece resulting in decreased specific grinding energy and/or reduced wheel wear.

The invention product differs from prior art in that no ceramic coating or glass binder is used as an adherent and filler coatings designed to react with the metal during grinding are not used. The invention product introduces a new concept in that filler materials are coated on the grain to react with the grain during grinding, while not reacting with the metal. It has been found that calcined magnesia and manganese dioxide are the preferred coating materials for this purpose and that the coating can be made as a first step in the mixing of abrasive, bond, and fillers preparatory to pressing or forming the bonded article.

It is obvious that minor changes may be made in the form and construction of the invention without departing from the material spirit thereof, It is not, however, desired to confine the invention to the exact form herein shown and described, but it is desired to include all such as properly come within the scope claimed.

The invention having been thus described, what is claimed as new and desired to secure by Letters Patent is:

1. An abrasive product comprised of abrasive grains selected from the group consisting of aluminous and silicon carbide which are at least partially coated with a substance selected from the group consisting of magnesium oxide and manganese oxide, and an organic synthetic resin binder for said abrasive grains.

2. The abrasive product of claim 1 wherein said abrasive product is a grinding wheel.

3. The abrasive product of claim 1 wherein said abrasive product is one where the abrasive grain is held to a backing by an organic polymer adhesive layer.

4. An abrasive product according to claim 1, 2, or 3, wherein said abrasive grain is one selected from the group consisting of fused aluminum oxide, sintered alumina, sintered bauxite, sintered sol gel alumina, seeded sol gel alumina, co-fused alumina-zirconia, sintered alumina-zirconia, and mixtures thereof.

5. An abrasive product according to claim 2 wherein said organic binder is one selected from the group consisting of phenoxy, phenol-furfural, aniline-formaldehyde, urea-formaldehyde, epoxy, cresol-aldehyde, resorcinol-aldehyde, urea aldehyde, phenol-formaldehyde, melamine-formaldehyde, and mixtures thereof.

6. An abrasive product according to claim 3 wherein said adhesive layer is one selected from the group consisting of phenol-formaldehyde, epoxy, urea-formaldehyde, melamine-formaldehyde, and animal glue.

7. The abrasive product of claim 1 wherein said coating on said abrasive grain constitutes from about 0.2% to about 3% by volume of said body.

8. An abrasive product according to claim 1, 2, or 3, wherein said organic polymer bond includes a filler selected from the group consisting of cryolite, sodium chloride, potassium fluorborate, fine silicon carbide, fibers, copolymer of vinyl and vinylidene chloride, iron sulfide, and mixtures thereof.

9. A method of forming an abrasive wheel, comprising the steps of:

(a) preparing a mass of aluminous abrasive grains,
(b) coating the grains with a powder of a coat material selected from the group consisting of magnesium oxide and manganese oxide,
(c) preparing a mixture of the coated grains with an organic synthetic resin binder binder,
(d) forming the mixture under pressure into a wheel-like form, and
(e) heating the form to set the binder.

10. A method as set forth in claim 9 wherein the coating of the grains is accomplished by first wetting the surfaces of the grains and the coat material is added to the wetted grains.

11. A method as set forth in claim 10 wherein the grain is wetted with furfural.

12. A method as set forth in claim 9 wherein the aluminous abrasive is selected from the group consisting of fused aluminum oxide, sintered alumina, sintered bauxite, sintered sol gel alumina, sintered seeded sol gel alumina, cofused alumina-zirconia, sintered alumina-zirconia, silicon carbide, and mixtures thereof.

13. A method as set forth in claim 9 wherein the organic binder is a thermosetting mixture of powdered novolac and hexamethylenetetramine cross-linking agent.

14. A method as set forth in claim 9 wherein the binder is a resin selected from the class consisting of phenoxy, phenol-furfural, analine-formaldehyde, urea-formaldehyde, epoxy, cresol-aldehyde, resorcinol-aldehyde, urea-aldehyde, melamine-formaldehyde, and mixtures thereof.

15. A method as set forth in claim 9 wherein the binder includes a filler.

* * * * *